US005108086A

United States Patent [19]

Seeber

[11] Patent Number: 5,108,086

[45] Date of Patent: Apr. 28, 1992

[54] PRINTING PRESS SHUNT ASSEMBLY

[75] Inventor: Heinz G. Seeber, Ludwigshafen am Rhein, Fed. Rep. of Germany

[73] Assignee: Albert-Frankenthal Aktiengesellschaft, Fed. Rep. of Germany

[21] Appl. No.: 695,714

[22] Filed: Feb. 15, 1991

[30] Foreign Application Priority Data

Feb. 24, 1990 [DE] Fed. Rep. of Germany ..... 4005873

[51] Int. Cl.[5] ..... B65H 39/10

[52] U.S. Cl. ..... 271/303; 271/287

[58] Field of Search ..... 271/225, 302, 303, 306, 271/310, 184, 280, 283, 284, 287

[56] References Cited

U.S. PATENT DOCUMENTS

| | | | |
|---|---|---|---|
| 3,170,686 | 2/1965 | Burkhardt et al. | 271/303 |
| 3,206,191 | 9/1965 | Hantscho | 271/303 X |
| 4,190,243 | 2/1980 | Michalik et al. . | |
| 4,373,713 | 2/1983 | Loebach | 271/302 X |
| 4,441,704 | 4/1984 | Uchida et al. | 271/303 |
| 4,729,282 | 3/1988 | Kasdorf | 271/302 X |

FOREIGN PATENT DOCUMENTS

| | | | |
|---|---|---|---|
| 0084931 | 8/1983 | European Pat. Off. | 271/303 |
| 0295636 | 12/1988 | European Pat. Off. | 271/303 |
| 678472 | 7/1939 | Fed. Rep. of Germany . | |
| 2233750 | 1/1974 | Fed. Rep. of Germany . | |
| 2723358 | 11/1983 | Fed. Rep. of Germany . | |
| 0022849 | 2/1984 | Japan | 271/184 |
| 0008160 | 1/1988 | Japan | 271/303 |
| 0028157 | 1/1989 | Japan | 271/184 |

*Primary Examiner*—H. Grant Skaggs
*Assistant Examiner*—Carol Lynn Druzbick
*Attorney, Agent, or Firm*—Jones, Tullar & Cooper

[57] ABSTRACT

A shunt assembly has a shunt segment which is pivotably supported for rapid movement between two signature outfeed paths. The shunt segment has spaced tines at its ends with these tines interdigitating with spaced signature transport tapes and rolls.

9 Claims, 4 Drawing Sheets

PRINTING PRESS SHUNT ASSEMBLY

FIELD OF THE INVENTION

The present invention is directed generally to a shunt assembly. More particularly, the present invention is directed to a shunt assembly in a web fed rotary printing press. Most specifically, the present invention is directed to a controllable shunt in a paper transport apparatus of a web-fed rotary printing press. The shunt assembly is controllably shiftable back and forth in a rhythmic or wave-like manner in conjunction with a flow of signatures passing through the paper transport apparatus. These signatures are shifted or shunted from a continual infeed stream of signatures into two outfeed component streams. The shunt assembly is pivotably supported and has tines or fingers at its leading and trailing ends. These tines interdigitate with the spaced signature conveying belts or tapes.

DESCRIPTION OF THE PRIOR ART

It is generally known in the prior art to provide alternate paths of travel for printed sheets, either singly, in groups, or as folded signatures in printing presses. These alternate paths of travel are often used to divide a continuous infeed stream of sheets or signatures into two or more alternating outflow streams. The separation of such a continuous stream so that individual elements can be fed onto various outgoing streams is often accomplished by a shunt assembly.

In German patent specification No. 678,472 there is shown a controllable shunt which is utilized in a paper transport apparatus of a web-fed rotary printing press. Another controllable shunt, which in this case is located in the output unit of a folder of a web-fed rotary printing press, is shown in German published unexamined patent application No. 2233750. This prior art patent application also shows a typical tape transport system and shows how such a transport system can be used to transport printed, folded signatures between the spaced tapes from one place to another place.

The production speeds of web-fed rotary printing presses have increased quite significantly over the past few years. This is particularly true of web-fed gravure presses. Printing presses that are capable of producing and folding 120,000 signatures per hour are currently available. This tendency toward bigger and faster presses appears to be a continuing one. In a press assembly that is capable of a production speed of this magnitude, the shunt assembly must switch between two outfeed paths at the rate of 60,000 changes of direction per hour. This equals to more than 16 times each second. As can be appreciated, such a high production speed has resulted in the life of the tool becoming shorter. In addition, various mineral constituents of the papers currently used have contributed to shortened shunt life. Such abrasive effects can cause production difficulties. They can also cause production interruptions which become necessary when used shunt segments are changed.

Shunt segments that are presently available typically utilize a thin peak segment. The signatures to be diverted run against this thin peak or point portion of the shunt segment. The material abrasion between the paper in the signatures and the thin peak segment of the shunt results in weakening and possible deterioration of the shunt segment within a short period of time. This short service life, as was discussed above, results in production troubles and equipment down time.

It will thus be apparent that a need exists for a durable, quick cycling shunt assembly. The printing press shunt assembly of the present invention provides such a device and is a significant improvement over prior art devices.

SUMMARY OF THE INVENTION

It is an object of the present invention to provide a shunt assembly.

Another object of the present invention is to provide a shunt assembly for a web-fed rotary printing press.

A further object of the present invention is to provide a controllable shunt in a paper transport apparatus of a web-fed rotary printing press.

Still another object of the present invention is to provide a shunt assembly which will operate at high production speeds.

Yet a further object of the present invention is to provide a shunt assembly that is not affected by abrasive paper.

Even still another object of the present invention is to provide a shunt assembly having transport belt interdigitating tines.

As will be discussed in detail in the description of the preferred embodiments, which is set forth subsequently, the shunt assembly in accordance with the present invention utilizes a shunt segment that is pivotable about a pivot axis to alternatively direct folded signatures arriving continuously from an infeed conveyor onto one of two spaced outfeed paths in an alternating or wave-like manner. The signatures are fed to the shunt, and are removed from the shunt by spaced tape transports that use spaced upper and lower conveying belts. The leading and trailing ends of the shunt assembly have a plurality of spaced, somewhat tooth or cog-shaped tines. These tines interdigitate with the spaced signature transport belts so that the shunt's leading and trailing ends can pass between the belts and thus through the path of signature travel. The angles of interception between the signatures and the signature support or guiding surfaces on the shunt assemblies are kept low so that there is provided a smooth transition between the signature infeed and the shunt. This keeps shunt surface abrasion to a minimum and facilitates rapid and smooth signature shunting to alternating paths.

A particular advantage of the shunt assembly of the present invention, in addition to the avoidance of the various limitations of the prior art devices, is that the point of impact of the folded signatures is not on the sides of a thin, flat peak of a shunt segment, as was the case with prior art devices. Additionally, the point of application of the force which controls shifting of the shunt segment does not have to be at the end which is facing the peak of the shunt segment. This allows a reduced driving torque to be used to shift the shunt segment.

The shunt segment of the present invention can be shorter than the prior art flat shunt segments. This shortens the distance along which the folded signature segments must be guided without a double tape guiding and transporting assembly. The signature infeed path between the infeed conveyor belt and the shunt segment can be generally funnel-shaped for at least one of the shunt paths.

The shunt segments, as they are formed more thickly, can be provided with cogs or teeth at one or both ends. The spaces between adjacent cogs or teeth provide room for the signature conveying belts or guiding rollers to run. This allows the upper and lower signature conveying belts to operate more closely to each other in the areas adjacent the shunt segments. This allows the shunt segment to be more compact in construction over the entire length of the shunt. This compact shunt construction, in turn, reduces the distance which the folded signature segments have to travel without being guided by double transport tapes. The lessening of this distance results in increased and more uniform signature transport speeds.

It will thus be seen that the printing press shunt assembly in accordance with the present invention overcomes the limitation of the prior art devices and is a substantial advance in the art.

BRIEF DESCRIPTION OF THE DRAWINGS

While the novel features of the printing press shunt assembly in accordance with the present invention are set forth with particularity in the appended claims, a full and complete understanding of the invention may be had by referring to the detailed description of preferred embodiments, as is set forth subsequently, and as illustrated in the accompanying drawings in which:

DETAILED DESCRIPTION OF PREFERRED EMBODIMENTS

Figure 1:
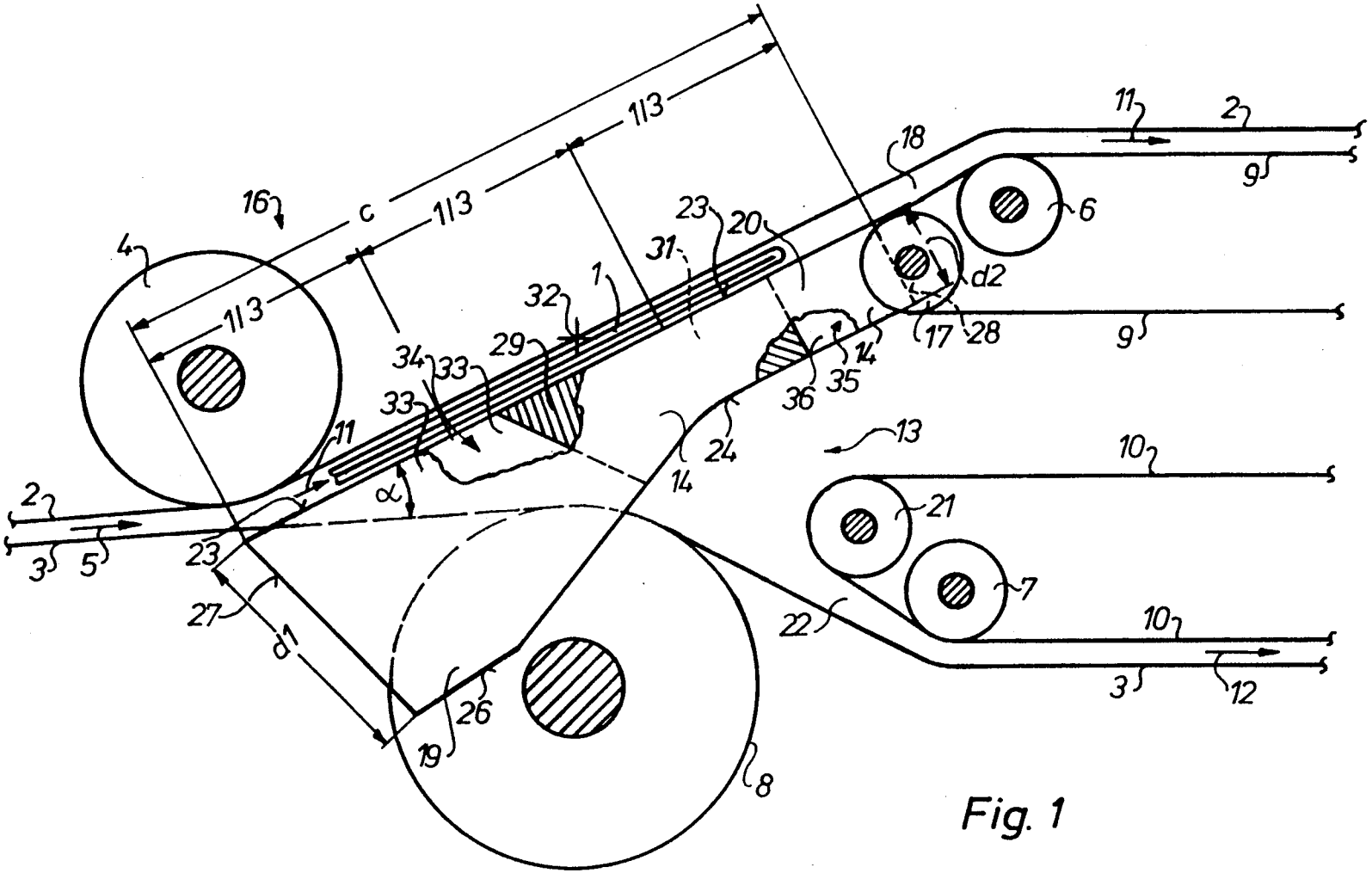
FIG. 1 is a schematic side elevation view, partly in section, of a first preferred embodiment of a shunt assembly in accordance with the present invention and showing the shunt assembly in a first switching position.
Figure 2:
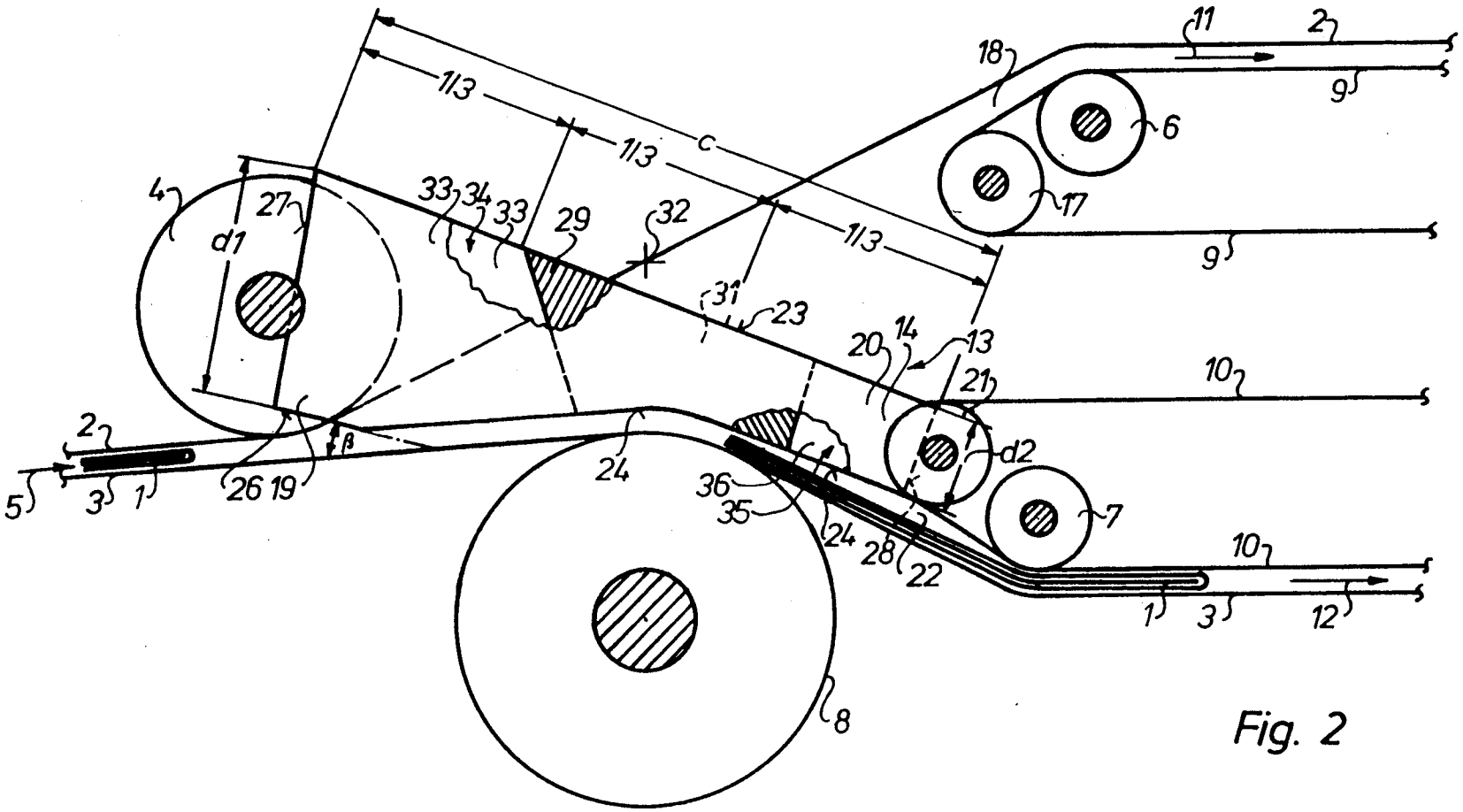
FIG. 2 is a view similar to FIG. 1 and showing the shunt assembly in a second switching position.

Referring initially to FIGS. 1 and 2, there may be seen generally at 16 a first preferred embodiment of a printing press shunt assembly for a folder in accordance with the present invention. Shunt assembly 16 is depicted receiving folded signatures 1 which are fed into the shunt assembly along an infeed conveying path 5. The signatures are shifted by the shunt assembly 16 to either an upper outflow conveying path 11 or to a lower outflow conveying path 12. It will be understood that the shunt assembly 16 operates in a rhythmic or wave-like manner so that each successive incoming folded signature 1 is alternately shunted to the upper or lower conveying path 11 or 12.

As seen in FIGS. 1 and 2, each arriving signature 1 is supported and transported along infeed conveying path 5 between spaced upper and lower transport belts 2 and 3, respectively. These transport belts are synchronously driven and are spaced apart from each other by a specific amount. Such transport belt assemblies are known generally in the art, as may be seen in, for example, German patent specification No. 2,723,358. Since they are generally conventional, they need not be discussed further. The incoming signatures 1 are clamped or held as they move along the incoming conveying path 5 between the upper and lower belts 2 and 3. They are also held properly centered so that they arrive at the shunt assembly 16 in the proper position and orientation.

As is shown in FIGS. 1 and 2, the upper conveying belts or tapes 2 run beneath a first upper tape guide roller 4 and over a second upper tape guide roller 6. These upper tape guide rollers 4 and 6 are rotatably supported in a conventional manner at the cross arm of the side frames of a folder (not shown). A lower conveying belt 9 of the upper outfeed path 11 also passes around the second upper tape guiding roller 6. While the upper belt 2 and the lower belt 9 are depicted as being spaced from each other, it will be understood that this spacing is caused by the placement of signatures 1 between these belts. Spaced upper idler rolls 17 coordinate with upper tape guiding roll or rolls 6 and guide the lower outfeed conveyor belts 9 of the upper outfeed path 11. The belts 9 coordinate with the upper infeed belts 2 to form an upper infeed mouth or gore 18 for the signatures 1 entering the upper outfeed path 11.

The lower conveying belt or belts 3 also pass under the first upper tape guide roll 4 and then pass over a first lower tape guiding roll 8 and under a second lower tape guiding roll 7. These rollers 7 and 8 are rotatably supported at lower cross arms between the side frames of the folder (not shown) in a manner similar to upper rollers 4 and 6. The lower conveyor belt or belts 3 cooperate with an upper conveyor belt 10 of the lower signature outfeed path 12. As seen in FIGS. 1 and 2, the upper outfeed conveyor belt 10 also passes around the second lower tape guide roller 7 to form the lower outfeed conveying path 12. Spaced lower idler rolls 21 cooperate with lower tape guiding roll or rollers 7 and guide the upper outfeed conveyor belts 10 of the lower outfeed conveyor path 12. The belts 10 cooperate with the lower infeed belts 3 to form a lower infeed mouth or gore 22 for the signatures 1 entering the lower outfeed path 12.

Shortly after upper infeed conveying belts 2 and lower infeed conveying belts 3 pass beneath the first upper tape guide roller 4, they diverge from their prior path along infeed conveying path 5 and form between themselves an acute angled space 13. A shunt segment, generally at 14, of the shunt assembly 16 is positioned in the acutely angled space 13. This shunt segment 14 effects the actual diversion of the folded signatures 1 between the upper and lower outfeed paths 11 and 12. The shunt segment 14 is somewhat rectangular in overall configuration. It has a generally planar upper guide surface 23, and a somewhat angled or curved lower guide surface 24. A blunt infeed front face or left surface 27 of the shunt 14, an outfeed rear face or right surface 28, and front and back side surfaces 29 and 31, respectively, cooperate to define the generally rectangular overall configuration of the shunt 14.

The upper and lower guide surfaces 23 and 24 of the shunt segment 14 are either partially or totally matched in surface shape or configuration to the course of the upper or lower outfeed conveying paths 11 and 12, as defined by the upper and lower infeed conveying belts 2 and 3, respectively. In the first preferred embodiment depicted in FIGS. 1 and 2, the upper guide surface 23 is generally planar while the lower guide surface 24 is rectilinear and planar in a first section 26 and is then concave so that when the shunt segment is in the position shown in FIG. 2, i.e., when a signature 1 is to be guided to the lower or second outfeed path 12, the lower guide surface 24 will overlie the lower infeed conveyor belt 3. It will be understood that other surface shapes of the upper and lower guide surfaces 23 and 24 are possible. For example, one of these guide surfaces could be convex, if appropriate.

The shunt segment 14 is supported for pivotal movement between the two positions shown in FIGS. 1 and 2. The shunt segment 14 in this first embodiment has a pivot axis 32 which lies outside and above the upper guide surface 23. This pivot axis 32 is generally in the central third 113 of the three segments 113 into which the overall length "c" of the upper guide surface 23 may be divided. The upper and lower guide surfaces 23 and 24 of the shunt segment 14 are at least as wide as the overall width of the tape guide rollers so that the signatures 1 are always completely supported by, or overlaid by, the shunt guide surfaces. Although not shown in FIGS. 1 and 2, it will be understood that shunt segment 14 has a support journal at each of its sides 29 and 31. These journals are supported in the side frames and allow the shunt assembly to move about the pivot axis 32. At least one of the journals is connected by a suitable connecting means, such as a slider crank mechanism (not shown) which is in cooperation with the drive of the main machine so as to run synchronously therewith. This allows the shunt segment !4 to move between the two positions shown in FIGS. 1 and 2 in proper cooperation with the feed of signatures I along the infeed conveying path 5.

A first generally planar end 19 of the shunt segment 14, which includes the infeed front face 27, has a thickness d 1. As seen in FIG. 1, this thickness may be the same as, or several times greater than a thickness d 2 of a second end 20 of the shunt segment 14. This first end 19 faces directly the infeed of the signatures 1 into the shunt space 13. The second end 20 which includes the outfeed rear face 28 of the shunt segment 14 faces the upper and lower infeed gores 18 and 22 of the upper and lower outfeed paths 11 and 12, respectively.

The width of the shunt segment !4 across its first or front end 19, and, if needed, across its second or read end 20 is formed having a plurality of tines or teeth 33 and 36, respectively. These tines or teeth 33 and 36 may be tooth-shaped or cog-shaped. The tines 33 and 36 are the portions of the upper guide surface 23 and the lower guide surface 24 which effect the change of direction of the signatures 1. These tines 33 and 36 form the surfaces of the upper and lower shunt guide surfaces 23 and 24 and the infeed front face 27 as well as the outfeed rear face 28.

A plurality of interspaces 34 and 35 are provided between the tines 33 and 36, respectively. These interspaces 34 allow the upper and lower infeed conveying belts 2 and 3 to pass between the tines 33. In a similar manner, the interspaces 35 allow these belts 2 and 3 as well as the lower outfeed conveyor belt 9 and the upper outfeed conveyor belt 10 of the upper outfeed path 11 and of the lower outfeed path 12, respectively, to pass through the second end 20 of the shunt segment 14. By placing the interspaces 34 formed between the tines 33 on either side of each of the infeed belts 2 and 3, it is possible to form so-called run-up angles $\alpha$ and $\beta$, as seen in FIGS. 1 and 2 respectively as acute angles. These run-up angles are the angles at which the signatures 1 contact the first end 19 of the shunt segment 14. In FIG. 1, the signatures 1 engage the upper guide surface 23 at the run-up angle $\alpha$ and in FIG. 2, the signatures 1 engage the lower guide surface 24 at the run-up angle $\beta$. The run-up angle $\alpha$ is the acute angle in which the upper guide surface or first signature run-up surface 23 cuts a plane along the surface of the lower conveyor belt 3, when the shunt segment 14 has reached a first shunt end position shown in FIG. 1, in which the conveying ways 5 and 11 are linked. The run-up angle $\beta$ is the acute angle, in which a prolongation of the second signature run-up surface 26 or the same cuts an imaginary plane along the transporting surface of the conveyor belt 3, when the shunt segment 14 has reached a second shunt end position shown in FIG. 2, in which the conveying ways 5 and 12 are linked. The lower run-up surface 26 can form, in an advantageous way, together with the front surface 27, a large angle.

Figure 3:
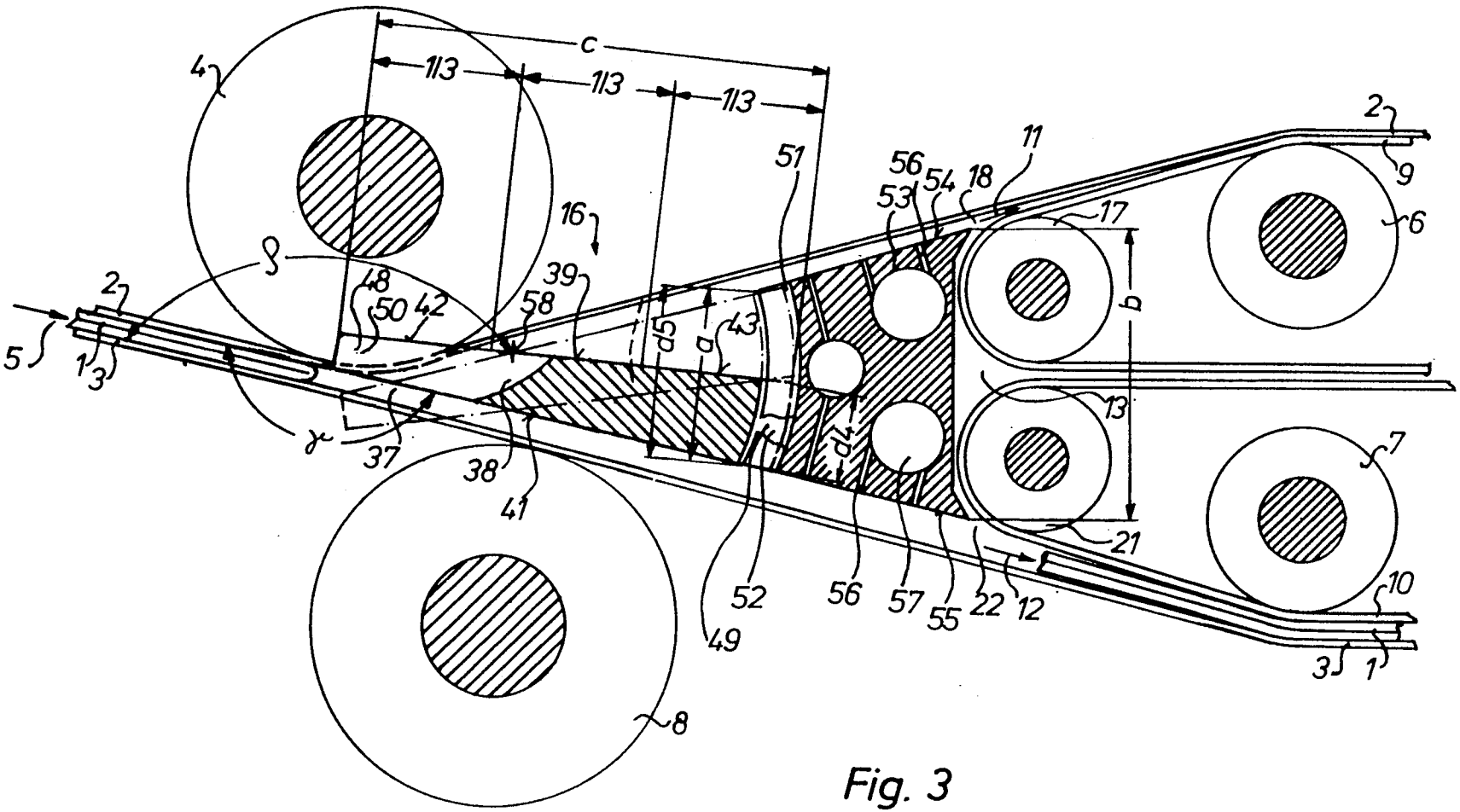
FIG. 3 is a schematic side elevation view, partly in section, of a second preferred embodiment of a shunt assembly in accordance with the present invention.
Figure 4:
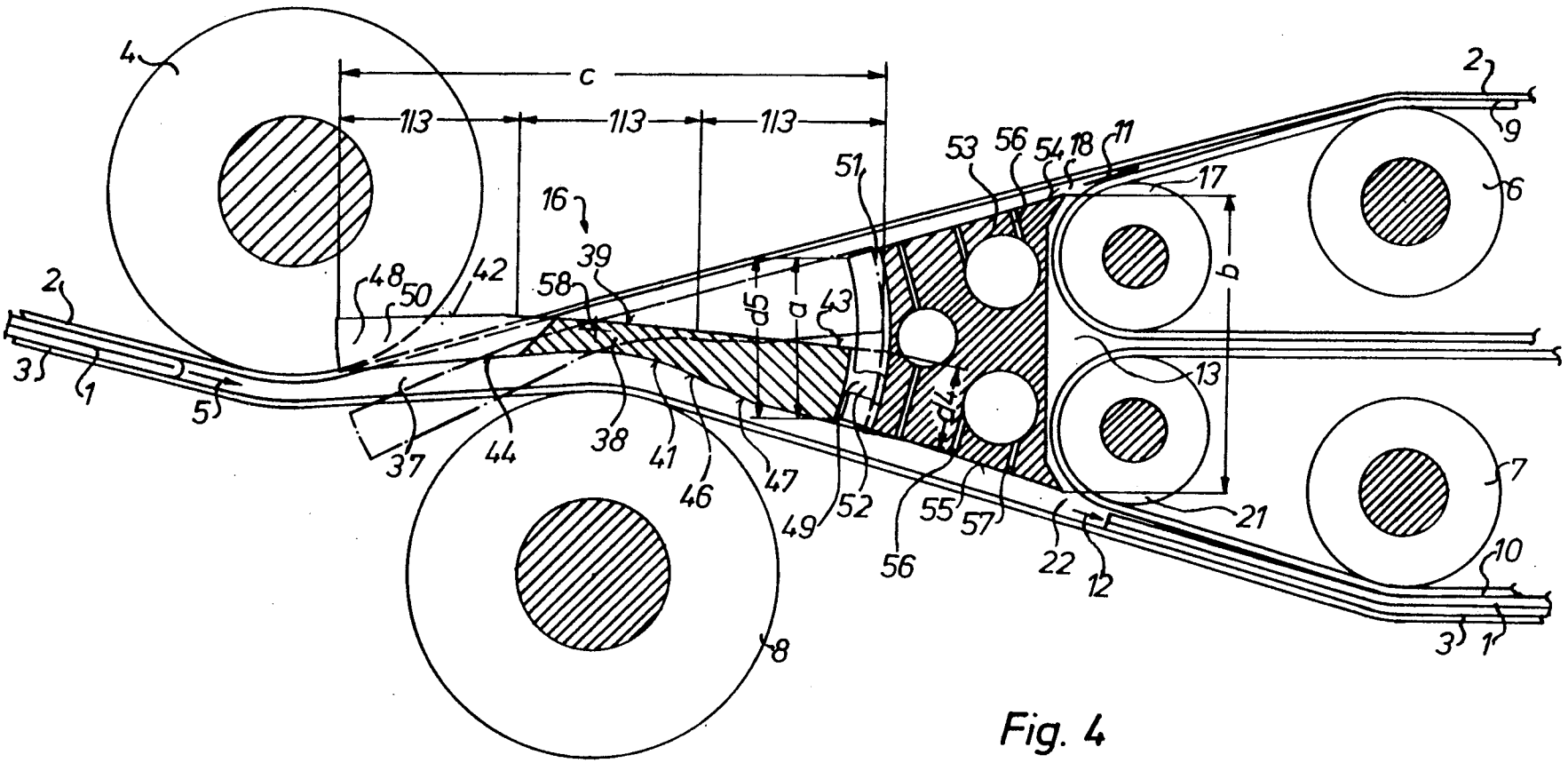
FIG. 4 is a schematic side elevation view, partly in section, of a third preferred embodiment of the shunt assembly.

Referring now to FIGS. 3 and 4, there may be seen second and third preferred embodiments, generally at 16, of shunt assemblies in accordance with the present invention. In these second and third preferred embodiments, with the exception of the shunt segments 14, the remainder of the shunt assemblies 16 are the same as was discussed in connection with the first embodiment. Thus the same numbers are used to designate corresponding elements in all three embodiments.

A guide block 53 is, in these second and third preferred embodiments, positioned in the space 13. This guide block 53 extends across the whole width of the signature transport apparatus. In these preferred embodiments, guide block 53 is generally trapezoidal in shape. The longer base side "b" faces the idler rollers 17 and 21 while the shorter base side "a" of the guide block 53 faces an infeed 37 of signatures 1 into the space 13. Upper and lower sides 54 and 55, respectively, of the guide block 53 form the guide surfaces for the upper and lower outfeed paths 11 and 12. The shorter base side "a" of the guide block 53 may be either cog- or tine-shaped or may have a concave shape, as seen in FIG. 3.

A shunt segment 38 is pivotably supported in space 13 before, in the direction of signature travel, guide block 53, as may be seen in FIGS. 3 and 4. In the second preferred embodiment, as seen in FIG. 3, the shunt segment 38 is generally flat whereas in the third preferred embodiment, as seen in FIG. 4, the shunt segment 38 is somewhat curved, all as will be discussed in detail hereinafter.

In the second preferred embodiment, the shunt segment has generally planar upper and lower guide surfaces 39 and 41, respectively. As depicted in solid lines in FIG. 3, when the shunt segment 38 is positioned in the so-called second shunt position so that the infeed conveying way 5 and the second or lower outfeed conveying path 12 are linked, then the lower guide surface 41, which extends across the width of the shunt segment 38, is matched to the course of the lower infeed conveying belt 3 through the shunt area. This path is defined by the first upper tape guiding roll 4, the first lower tape guiding roll 8 and the second lower tape guiding roll 7. In this second shunt position shown in solid lines in FIG. 3, the lower guide surface 41 of the shunt segment 38 is generally in the same plane with the lower conveying surface of the upper conveying belt 2 before it passes around guide roller 4. Alternatively, the planes of surface 41 and belt 2 intersect each other at an exterior angle F which is greater than 90°. When the shunt segment 38 is in the first shunt position which is shown in dot-dash lines in FIG. 3, in which the infeed conveying way 5 and the first or upper outfeed conveying way 11 are linked, the upper guide surface 39 intersects the imaginary plane which is defined by the surfaces of the lower infeed conveying belts 3. This angle of intersection δ is, as may also be seen in FIG. 3, greater than 90°.

In the third preferred embodiment, as shown in FIG. 4, the shunt segment 38 has an upper guide surface 39 which is formed by two adjacent, generally planar surface portions 42 and 43. The lower guide surface 41 of the shunt segment 38 in FIG. 4 is comprised of a first planar surface 44, a concave intermediate surface 46 and a second planar surface 47. It will be apparent that other shapes for the upper and lower guide surfaces 39 and 41 could also be utilized. The shapes of these surfaces will be dictated by the courses of the conveying ways 5, 11 and 12 required by the shunt assembly 16.

In both the second and third preferred embodiments shown in FIGS. 3 and 4, respectively, the shunt segment includes a solid body portion which is somewhat in the shape of a flat extended quadrangle with unequal sides in cross-section. Either the left end 48, the right end 49, or both ends 48 and 49 of the shunt segment 38 can be provided with a plurality of tines or tooth-shaped projections 50 and 52, respectively. The tines 50 on the left or infeed end of the shunt segment 38, which are the ones that engage the incoming folded signature 1, are sufficiently long that they do not have to have a point or peak at their free ends. Thus they can be quite blunt. These teeth or tines 50 are made sufficiently long so that when they are in the first and second switching positions of the shunt assembly 16 that their guide surfaces 39 and 41 either cut through or, at the least, intersect the imaginary plane or conveying way defined by the conveying surfaces of the upper and lower infeed conveying belts 2 and 3.

The tines or teeth 52 which are formed on the right or trailing end 49 of the shunt segment 38 in both of the second and third preferred embodiments cooperate, or interdigitate with the tooth-shaped projections 51 of the guide block 53. The shorter end "a" of the trapezoidal guide block 53 is thus facing the right end of the shunt segment 38. The thickness d 4 of this right end 49 of the shunt segment 38 is smaller than, and preferably about one-half of the thickness d 5 of the guide block 53, with this guide block thickness d 5 being measured along the shorter end "a" of the guide block 53 which is facing the shunt segment 38.

The shunt segments 38 of the second and third preferred embodiments are supported for pivotable movement between the two switching positions depicted in both FIGS. 3 and 4. This pivotable movement is accomplished in a manner similar to that described with respect to the first preferred embodiment. Shunt segment 38 is pivotable about a horizontal pivot or swivel axis 58 so it can be moved by a suitable drive assembly (not shown) between the first and second shunt positions. The pivot axis 58 is located generally at the upper guide surface 39 of shunt segment 38, as seen in FIG. 3, or within the shunt segment 38, as shown in FIG. 4. In either case, the axis 58 is located in the central one of three equal segments into which the length of shunt segment 38 is capable of being divided.

The upper, non-parallel surface 54 of the guide block 53 cooperates with the upper guide surface 39 of the shunt segments 38 in both second and third preferred embodiments to form the lower surface of the upper outfeed path 11 when the shunt segment 38 is in the position depicted in dot-dash lines in FIGS. 3 and 4. Similarly, the lower, non-parallel surface 55 of the guide block 53 cooperates with the lower guide surface 41 of the shunt segment 38 to form the upper surface of the lower outfeed path 12 when the shunt segment 38 is in the position shown by solid lines in FIGS. 3 and 4. The signatures I thus pass in contact with these surfaces 54 and 55. In both positions of the shunt segment 38, the shunt guide surfaces 39 and 41 blend into their cooperating surfaces 54 and 55, respectively, of the guide block 53.

The upper and lower guide surfaces 54 and 55 of the guide block 53 of both second and third preferred embodiments can be provided with a plurality of spaced outlets 56 for the discharge of compressed air onto the guide surfaces 54 and 55. These outlets 56 are supplied with compressed air by longitudinal boreholes 57 that pass through the interior of the guide block 53. This block is fixed between the side frames of the apparatus and may be supplied with compressed air from any suitable source. The movable shunt segments 14 and 38 can also have their upper and lower guide surfaces provided with similar compressed air outlets 56. These can be supplied with compressed air through longitudinal boreholes 57 in a manner similar to that depicted for guide block 53. The use of compressed air reduces friction between the guide surfaces and the signatures 1.

While preferred embodiments of a printing press shunt assembly in accordance with the present invention have been set forth fully and completely hereinabove, it will be apparent to one of skill in the art that a number of changes in, for example, the sizes of the tape guiding rolls, the number of conveying belts, the supports for the rollers and belts and the like may be made without departing from the true spirit and scope of the present invention, which is accordingly to be limited only by the following claims.

What is claimed is:

1. A controllable shunt assembly for splitting a stream of signatures being fed into said shunt assembly into at least two outfeed paths, said shunt assembly comprising:

a plurality of spaced conveyor belts feeding said stream of signatures to said shunt assembly;

a generally rectangular shunt segment supported for pivotable movement in a shunt space between first and second signature guide positions in accordance with a rhythm of said signatures to split said signatures alternatingly between said at least two outfeed paths;

first and second spaced signature run-up surfaces on first and second spaced signature guide surfaces of said shunt segment, said first and second guide surfaces guiding alternating ones of said signatures, each of said first and second spaced signature guide surfaces forming an acute angle with said conveyor belts when said generally rectangular shunt segment is in said first or second signature guide position; and a first generally blunt planar end of said shunt segment having an infeed front face facing said plurality of spaced conveyor belts, said first generally blunt planar end having a thickness at least as thick as a second end of said shunt segment.

2. The controllable shunt assembly of claim 1 wherein said shunt segment is pivotable about a pivot axis which passes above said shunt segment within a central third of the length of said shunt segment.

3. A controllable shunt assembly for splitting a continuous stream of signatures into at least two component streams of signatures, said shunt assembly comprising:

a plurality of spaced infeed conveying belts forming a signature infeed conveying path;

a shunt segment supported for pivotable movement between first and second signature guide positions in accordance with a rhythm of said signatures to divide said stream of signatures into said two component streams;

first and second spaced outfeed conveying paths to alternatingly receive signatures from said shunt segment; and a guide block positioned between said signature infeed conveying path and said first and second outfeed conveying paths and after said shunt segment, an end of said guide block facing said shunt segment having a thickness greater than a thickness of an end of said shunt segment adjacent said guide block.

4. The shunt assembly of claim 3 wherein said end of said guide block facing said shunt segment is provided with projections.

5. The shunt assembly of claim 3 wherein said end of said shunt segment adjacent said guide block is provided with projections.

6. The shunt assembly of claim 5 further including a plurality of projections on said end of said guide block facing said shunt segment and wherein said guide block projections and said shunt segment projections interdigitate.

7. The controllable shunt assembly of claim 3 further including a plurality of compressed air outlets on signature guide surfaces of said guide block and means to supply compressed air to said compressed air outlets from a source of compressed air.

8. The controllable shunt assembly of claim 3 wherein said shunt segment is provided with spaced upper and lower signature guide surfaces.

9. The controllable shunt assembly of claim 3 wherein said segment is pivotable about a pivot axis which passes across said shunt segment within a central third of the length of said shunt segment.

* * * * *